United States Patent [19]

Arndt et al.

[11] Patent Number: 4,686,901

[45] Date of Patent: Aug. 18, 1987

[54] METHOD AND DEVICE FOR REMOVING SPOTS FROM A PRINTING PLATE

[75] Inventors: Jentzsch Arndt, Coswig; Guenter Schumann; Wolfgang Stellmacher, both of Radebeul, all of German Democratic Rep.

[73] Assignee: VEB Kombinat Polygraph "Werner Lamberz" Leipzig, Leipzig, Fed. Rep. of Germany

[21] Appl. No.: 915,802

[22] Filed: Oct. 6, 1986

[51] Int. Cl.[4] ..... B41L 25/16

[52] U.S. Cl. ..... 101/148; 101/425

[58] Field of Search ..... 101/148, 425

[56] References Cited

U.S. PATENT DOCUMENTS

| | | | |
|---|---|---|---|
| 3,508,489 | 4/1970 | Norton | 101/148 |
| 3,673,959 | 7/1972 | Jesuit | 101/425 |
| 3,842,735 | 10/1974 | Southam | 101/148 |
| 3,911,815 | 10/1975 | Banfer | 101/148 |
| 4,066,017 | 1/1978 | Garcowiski | 101/148 |

FOREIGN PATENT DOCUMENTS

| | | | |
|---|---|---|---|
| 19073 | 11/1980 | European Pat. Off. | 101/148 |
| 22191 | 1/1981 | European Pat. Off. | 101/148 |
| 3308905 | 12/1983 | Fed. Rep. of Germany | 101/148 |
| 3416845 | 11/1984 | Fed. Rep. of Germany . | |
| 227090 | 9/1985 | Fed. Rep. of Germany | 101/148 |
| 1295604 | 11/1972 | United Kingdom | 101/148 |

*Primary Examiner*—Clyde I. Coughenour

*Attorney, Agent, or Firm*—Michael J. Striker

[57] ABSTRACT

A method and device for removing spots from a printing plate of a printing machine having a moistening mechanism with an application roller and an immersion roller immersed in a container with a moistening agent and operated in contact with the application roller for application of a moistening agent to the printing plate, wherein the application roller is driven by a plate cylinder connected to the application roller in a form-locking manner, with an interposition of a switching coupling, so that a peripheral speed of the application roller in a coupled position is lower than that of the plate cylinder. The drive also includes a hydraulic cylinder connected by a scanner and a switch to an electric motor for driving the immersion roller.

3 Claims, 2 Drawing Figures

METHOD AND DEVICE FOR REMOVING SPOTS FROM A PRINTING PLATE

BACKGROUND OF THE INVENTION

The present invention relates to a method and device for removing coat spots from a printing plate of a printing machine wherein the printing plate is cleaned or wiped off by means of application roller of a three-roller moistening mechanism.

A moistening mechanism for supplying a moistening agent, e.g. moistening liquid, to a printing plate of the printing machine has been disclosed, for example in DE-OS No. 34 16 845. In this conventional moistening mechanism, the roller for the application of a moistening agent is driven by the drive of the printing machine due to the provision of a form-locking connection therebetween. The connection is carried out by a gear train drive which is provided with a push pressure-actuated coupling so that the moist application roller can be selectively utilized with or without the gear train drive. The drive ratios are selected so that in the coupled condition, the peripheral speed of the application roller is substantially lower than that of the printing plate, and the continual wiping effect (Delta-effect) takes place on the plate whereby the coat spots are removed from the printing plate.

A disadvantage of the convention device resides in that with a continual use of the Delta-effect the printing plate can wear off sooner. Periodic switchings-off of the Delta-effect within one printing application are not possible because very high differences in inking occur, which generate due to the difference in application of the moistening agent, a speed difference with or without Delta-effect.

SUMMARY OF THE DISCLOSURE

It is an object of the present invention to provide an improved method and device for removing coat spots from a printing plate.

It is another object of the invention to provide a device for removing spots from the printing plate, by which the quality of printing will be improved, the amount waste paper will be reduced, and intervals between washings of the printing plate would be extended.

Yet another object of the invention is to provide a method and device for removing coat spots from the printing plate, wherein the supply of the moistening agent would be adjusted to various speeds of the application roller.

These and other objects of the invention are attained by a method of removing spots from a printing plate of a printing machine by means of an application roller of a mechanism also having an immersion roller immersed in a container with a moistening agent and operated in contact with said application roller for application of a moistening agent to the printing plate, wherein the application roller can be driven by a plate cylinder connected thereto in a form-locking manner with an interposition of a switching coupling so that a peripheral speed of the application roller in a coupled position is lower than that of the plate cylinder, the method comprising the step of driving the immersion roller with a higher speed for a time period during which the application roller is in the coupled position.

The objects of this invention are also attained by a device for removing spots from a printing plate of a printing machine having a moistening mechanism with an application roller and an immersion roller immersed in a container with a moistening agent and operated in contact with said application roller for application of a moistening agent to the printing plate and an electric motor for driving said immersion roller, the device comprising means for driving the application roller by a plate cylinder connected thereto in a form-locking manner with an interposition of a switching coupling so that a peripheral speed of the application roller in a coupled position is lower than that of the plate cylinder; said means including a hydraulic cylinder, a rod connecting said hydraulic cylinder with said switching coupling, a scanner, and a switch contact connected to said scanner, said hydraulic cylinder being in connection with said electric motor through said switch contact and said scanner.

Due to the present invention fluctuations of the ink-moisture balance with the Delta-effect and also the amount of waste paper occurring in the printing process are substantially reduced or eliminated.

The novel features which are considered as characteristic for the invention are set forth in particular in the appended claims. The invention itself, however, both as to its construction and its method of operation, together with additional object and advantages thereof, will be best understood from the following description of specific embodiments when read in connection with the accompanying drawing.

DETAILED DESCRIPTION OF THE PREFERRED EMBODIMENT

Figure 1:
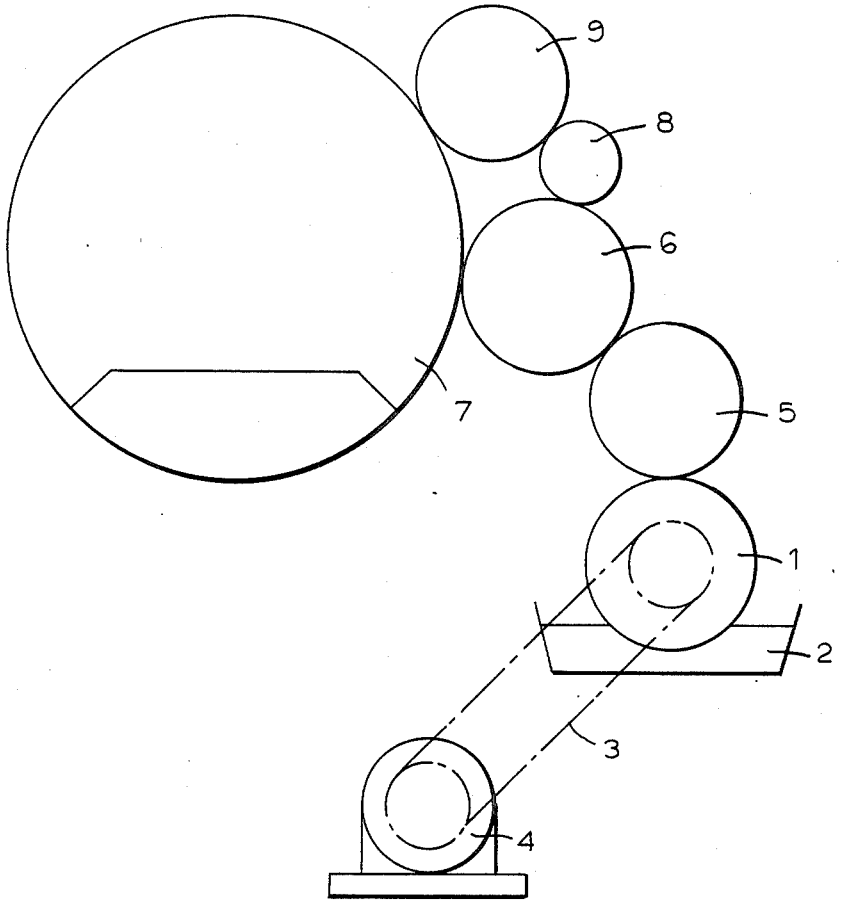
FIG. 1 is a schematic view of a moistening mechanism.

Referring now to the drawing in detail it will be seen that FIG. 1 shows the moistening mechanism which is comprised of a 3-roller system.

An immersion roller 1 is arranged so that its outer surface is moistened with a wetting liquid in an operational position. The moistening or wetting liquid in contained in a container 2 positioned below immersion roller 1.

Via a suitable translation element, for example a gear belt 3, the immersion roller 1 is connected with a stepless adjustable electric motor 4. A transfer roller 5 is mounted above immersion roller 1 with this roller connected in a form-locking manner. Transfer roller 5 is in contact with a plate cylinder 7 via an application roller 6.

A switchable bridging or connection roller 8 is arranged above application roller 6. The bridging roller 8 can connect application roller 6 with a first ink-applying roller 9. The bridging roller 8 can be engaged either with the application roller 6 or with the ink-applying roller 9 or can be completely disconnected from both rollers.

The plate cylinder 7 can be connected in a form-locking manner with the main drive of the printing machine.

Figure 2:
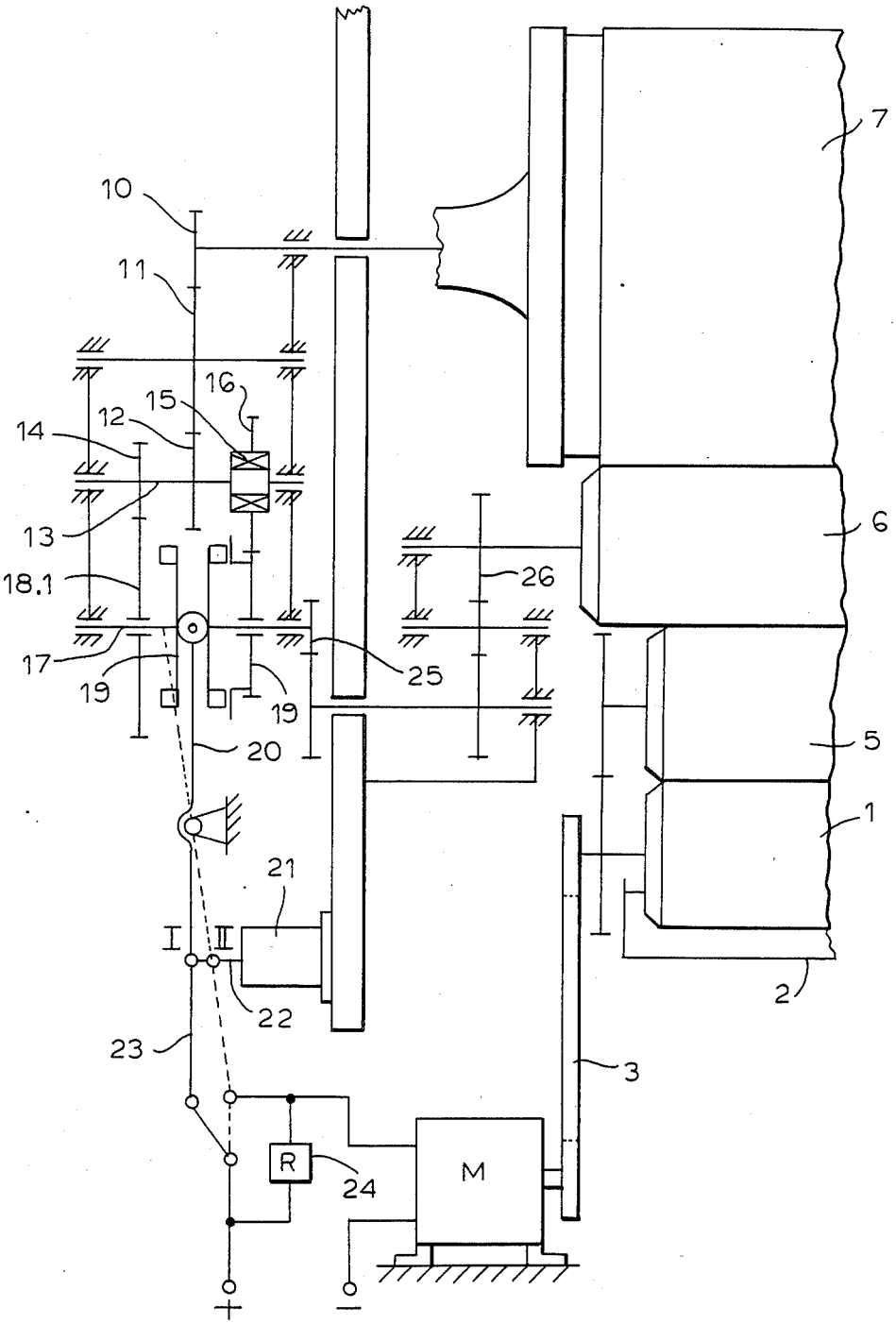
FIG. 2 is a schematic view of the moistening mechanism with a drive gear train.

With reference to FIG. 2, it will be seen that a drive train gear 10 is rigidly connected to the drive side of the plate cylinder 7. An intemediate gear 11 which is in mesh with gear 10 is also in connection with a transfer gear 12. An auxiliary gear 14 and a toothed crown 16 coupled with a free-wheeling gear 15 are rigidly mounted on a rotational shaft 13. The toothed crown 16 and the auxiliary gear 14 are in mesh with coupling gears 18 and 18.1 respectively rotationally supported on a coupling shaft 17. Axially displaceable but radially fixed is a switching coupling 19 on the coupling shaft 17. The switching coupling 19 is connected via a rod 20 with a hydraulic cylinder 21 which switchable to positions I and II.

A switching means 23, which is resistant to bending, is also connected to a piston rod 22 of the hydraulic cylinder 21. Switching means 23 cooperates with a scanner 24. The latter is connected to an electric circuit leading to the electric motor 4.

A driven gear mounted on the coupling shaft 17 is in mesh, via further gear connections, with a driving gear 26 for the application roller 6.

The mode of operation of the device according to the present invention is as follows:

Upon a rotation of the immersion roller 1, the moistening agent is transmitted by the transfer-roller 5 and the application roller 6 a printing plate fixed to the plate cylinder 7.

Due to the form-locking connection the transfer roller 5 rotates with the same peripheral speed as that of the immersion roller 1. The plate cylinder 7 rotates with the speed of the printing machine and drives, via friction, the application roller 6 at the same peripheral speed.

The hydraulic cylinder 21 is positioned thereby in the switch position I so that the torque is applied on the toothed crown 16 of the free-wheeling gear 15 and the coupling gear 18. The free-wheeling gear 15 is activated only when the application roller 6 rotates slower than the plate cylinder 7. This, for example is the case when the application roller 6 passes the plate cylinder channel and has no frictiction drive.

If now the spots on the printing plate are noticable, which spots are visible on the sheets being printed due to partial fluctuations of ink thickness, the hydraulic cylinder 21 is moved by pressure to the position II.

The switching coupling 19 moves to the left, and the torque results over a large coupling gear 18.1. The continual form-locking connection between the plate cylinder 7 and the application roller 6 is established. Due to the large diameter of the coupling gear 18.1 as opposed to that of gear 18, the speed of the application roller driven by the form-locking connection at this moment is substantially lower than that of the plate cylinder 7. Thus a wiping action on the printing plate takes place so that spots of superfluous ink are removed therefrom. During this wiping effect the supply of the moistening agent to the printing plate is decreased in accordance with the lower speed of the application roller whereby a grooved film can occur. For this reason, upon the actuation of the hydraulic cylinder 21 to the position II, the scanner 24 with the resistance connected thereto is shunted, and the number of revolutions of the electric motor 4 and thus the immersion roller 1 via the gear belt 3 are increased. Thus more moistening agent is supplied so that the amount of the moistening agent fed to the printing plate is the same with the coupled delta-effect.

After the removal, the hydraulic cylinder 21 is switched to the position I and the speed of the application roller 6 is again increased and the immersion roller 1 rotates slower so that the amount of the moistening agent supplied to the printing plate in both speed conditions of the application roller 6 is always the same.

It will be understood that each of the elements described above, or two or more together, may also find a useful application in other types of method and devices for the removal of coating spots from a printing plate differing from the types described above.

While the invention has been illustrated and described as embodied in a method and device for the removal of coating spots from a printing plate, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, falrly constitute essential characteristics of the generic or specific aspects of this invention.

What is claimed as new and desired to be protected by Letters Patent is set forth in the appended claims:

1. In a method of removing spots from a printing plate of a printing machine by means of an application roller of a moistening mechanism also having an immersion roller immersed in a container with a moistening agent supply for said application roller for application of the moistening agent to the printing plate, wherein the application roller can be driven by a plate cylinder connected thereto in a form-locking manner, an interposition switching coupling so that a peripheral speed of the application roller in a coupled position is lower than that of the plate cylinder, the method comprising periodically engaging said switching coupling with said application roller so that the peripheral speed thereof is lower than that of the plate cylinder, driving the immersion roller with a higher speed for a time period during which the application roller is in the coupled position.

2. A device for removing spots from a printing plate of a printing machine having a moistening mechanism with an application roller and an immersion roller immersed in a container with a moistening agent and operated with said application roller for application of a moistening agent to the printing plate, an electric motor for driving said immersion roller, means for driving the application roller by a plate cylinder connected thereto in a form-locking manner, an interposition switching coupling so that the peripheral speed of the application roller in a coupled position is lower than that of the plate cylinder, said means further including a hydraulic cylinder, a rod connecting said hydraulic cylinder with said switching coupling, a scanner, and a switch contact connected to said scanner, said hydraulic cylinder being in connection with said electric motor through said switch contact and said scanner so as to drive said immersion roller with a higher speed for a time period during which the application roller is in the coupled position.

3. The device as defined in claim 2 wherein the connection between said coupling and said application roller is carried out by a gear train.

* * * * *